US011285980B2

(12) United States Patent
Popplewell

(10) Patent No.: US 11,285,980 B2
(45) Date of Patent: Mar. 29, 2022

(54) SPEED PROVING METHOD AND APPARATUS

(71) Applicant: RAIL CONTROL SYSTEMS AUSTRALIA PTY LTD, Melbourne (AU)

(72) Inventor: Neil Popplewell, Melbourne (AU)

(73) Assignee: RAIL CONTROL SYSTEMS AUSTRALIA PTY LTD, Melbourne (AU)

( * ) Notice: Subject to any disclaimer, the term of this patent is extended or adjusted under 35 U.S.C. 154(b) by 278 days.

(21) Appl. No.: 16/462,882

(22) PCT Filed: Nov. 21, 2017

(86) PCT No.: PCT/AU2017/051280
§ 371 (c)(1),
(2) Date: May 21, 2019

(87) PCT Pub. No.: WO2018/090106
PCT Pub. Date: May 24, 2018

(65) Prior Publication Data

US 2019/0300029 A1 Oct. 3, 2019

(30) Foreign Application Priority Data

Nov. 21, 2016 (AU) ..... 2016904759

(51) Int. Cl.

| | |
|---|---|
| ***B61L 13/00*** | (2006.01) |
| ***B61L 29/32*** | (2006.01) |
| ***B61L 29/22*** | (2006.01) |
| ***B61L 25/02*** | (2006.01) |
| ***B61L 1/16*** | (2006.01) |

(52) U.S. Cl.
CPC ..... *B61L 13/002* (2013.01); *B61L 1/16* (2013.01); *B61L 25/021* (2013.01); *B61L 29/22* (2013.01); *B61L 29/32* (2013.01)

(58) Field of Classification Search
CPC ..... B61L 13/002; B61L 1/16; B61L 25/021; B61L 29/22; B61L 29/32
See application file for complete search history.

(56) References Cited

U.S. PATENT DOCUMENTS 3,929,307 A * 12/1975 Geiger ..... B61L 1/187 246/130
4,581,700 A * 4/1986 Farnham ..... B61L 29/226 246/121

(Continued)

FOREIGN PATENT DOCUMENTS

EP 3050774 A1 8/2016
WO WO2009/100292 A1 8/2009

OTHER PUBLICATIONS

International Search Report and Written Opinion dated Jan. 29, 2018, for corresponding international application No. PCT/AU2017/051280.

*Primary Examiner* — Jason C Smith
(74) *Attorney, Agent, or Firm* — K&L Gates LLP

(57) ABSTRACT

The present invention relates to methods of improving the reliability and accuracy of level crossing warning systems. The invention is comprised of an axle counter based system that detects the presence and calculates the speed of a train approaching a level crossing and adjusts the activation time for any warning system using a pre-defined period.

15 Claims, 4 Drawing Sheets

(56) References Cited

U.S. PATENT DOCUMENTS

| | | | | |
|---|---|---|---|---|
| 5,621,195 | A * | 4/1997 | Taylor | G01B 7/02 177/133 |
| 7,575,202 | B2 * | 8/2009 | Sharkey | B61L 29/32 246/111 |
| 8,297,558 | B2 * | 10/2012 | O'Dell | B61L 29/226 246/126 |
| 8,725,405 | B2 * | 5/2014 | Steffen, II | B61L 29/226 701/400 |
| 2012/0056042 | A1 * | 3/2012 | Denny | B61L 17/02 246/122 R |
| 2012/0138752 | A1 * | 6/2012 | Carlson | B61L 3/02 246/126 |
| 2012/0217351 | A1 * | 8/2012 | Chadwick | B61L 29/32 246/169 R |
| 2013/0194423 | A1 * | 8/2013 | Baines | G08G 1/0175 348/148 |
| 2014/0326835 | A1 * | 11/2014 | Schwellnus | B61L 25/04 246/122 R |
| 2015/0307119 | A1 * | 10/2015 | Ghaly | B61L 25/06 246/122 R |
| 2019/0300029 | A1 * | 10/2019 | Popplewell | B61L 1/16 |

* cited by examiner

SPEED PROVING METHOD AND APPARATUS

FIELD OF THE INVENTION

The present invention relates generally to methods and systems for use in the rail industry and in particular relating to methods and systems comprising an axle counter based system that detects the presence and calculates the speed of a train approaching a level crossing and adjusts the activation time for any warning system using a pre-defined period.

BACKGROUND TO THE INVENTION

Level crossings (sometimes referred to as grade crossings) comprise junctions between railways and other vehicle carriage ways (such as roads, light rail track, monorail, bicycle paths, aircraft runways) and pedestrian walkways. A crossing may be an intersection between road, pedestrian footpath, tramway, light rail, or other similar intersection/crossing or any combination of those crossings. A rail vehicle may be train, locomotive, hi-rail, railcar, wagon, tram, light rail vehicle, or any other type of rail vehicle that may be on the rail. In this document, the word train may be used interchangeably with 'rail vehicle' to refer to any of these rail vehicles.

Rail vehicles, given their larger mass and relative braking capability, have a far longer braking distance than road vehicles. Modern level crossings, therefore, rely on other vehicles and pedestrians to stop. This results in an inherent safety risk, as other road users are expected to comply with the requirement to give way at road/rail junctions.

Early level rail crossings engaged a flagman in a nearby booth who would, on the approach of a train, wave a red flag or lantern to stop all traffic and clear the tracks. The solution progressed to manually or electrically closable gates that barricaded the roadway. These gates were intended to be a complete impediment against the intrusion of any road traffic onto the railway. In the early days of the railways, much road traffic was horse drawn or included livestock, requiring a full barrier crossing the entire width of the road. When opened to allow road users to cross the tracks, the gates were swung across the width of the railway, preventing any pedestrians or animals getting onto the tracks. As motor vehicles became more prevalent with the subsequent reduction of pedestrian traffic, this type of control became less effective. Additionally, the need for a barrier to livestock diminished dramatically. Many countries, therefore, replaced the fully gated crossings with weaker but more-visible barriers and relied upon road users obeying the associated warning signals to stop.

Level crossings may employ passive systems, in the form of warning signs, or active systems that utilise automatic warning devices such as flashing lights, warning bells/tone and boom gates. Traditionally, active systems detect a train approaching the crossing by one of the following means:

- A track circuit system that senses the presence of a train because of the train's wheels and axle(s) short circuiting the rails;
- An axle counter system that simply counts and/or senses the presence of a train wheel or axle and uses this as the basis for activating the warning device;
- The use of a level or grade crossing predictor that constantly measures the speed of the train by measuring the impedance of a section of the rail wherein the impedance of a rail section reduces as a train approaches due to the train wheels short circuiting the rails.

While the preceding methods have been in existence for some time and are accepted by the rail industry to varying levels throughout the world, there are a significant number of disadvantages associated with these methods, including:

- Track circuits and grade crossing predictors rely on the ability for the train's axles to effectively short circuit the rail. These methods rely on sufficient rail traffic, rail vehicle maintenance, track maintenance, and equipment maintenance to ensure the rail and wheel interface is sufficiently conductive and tuned to reliably and accurately detect the train's axles. The wheel profile must be correct and, there shall be no or minimal contamination on the track and the train wheels/axles. These requirements can add significant maintenance costs and/or risk to the railway as it requires personnel to be present on the tracks for such maintenance, which increases safety risk for personnel and may result in schedule delays. If tracks are improperly maintained and managed, or there is an unpredicted event, then there is a risk that a train will not activate the crossing at all or will activate the crossing late thus providing insufficient warning time to other vehicles or pedestrians using the crossing. An unprecedented even coudl be one that causes contamination to the rails (for example soil, rocks, moisture, and the like);
- Track circuits and axle counter systems are usually incapable of distinguishing a train's speed and therefore must assume that a train is travelling at the maximum authorised speed. This causes level crossing protection systems to activate for longer than necessary for trains that travel less than maximum speed. In many railway environments, such as those that have both freight and passenger trains, there may be large differences in speed between the various types of trains that are running on any single track. This can lead to very long warning activation times, which can in-turn unnecessarily delay other vehicles at the crossing. This may lead to increases in traffic congestion, noise pollution, greenhouse emissions from vehicles waiting at crossings and also increases the risk of vehicles or pedestrians going against the advice of the level crossing protection system, which may endanger their or others (such as those onboard the train or waiting at the crossing). For example, it is not uncommon for there to be freight trains that travel in order of four times slower than the maximum authorised line speed, which would lead to the crossing warning time being four times longer than necessary (noting the necessary time is dictated by the relevant railway regulations, standards, and legislation for the area the crossing is installed);
- Level or grade crossing predictors are often not suitable for use in electrified railways, or in railways with other electrical noise that may interfere with the grade crossing predictors audio frequency signals;
- Level or grade crossing predictors and track circuits may interfere with other level or grade crossing predictors or track circuits, which may be used for other level crossings or other railway signalling purposes. This may result in additional systems being required to filter any signal interference, or the system may need to be designed in a more complicated fashion or with other undesirable features, such as longer crossing warning times or reduced signalling functionality. Interface and the additional components and/or complexity associated with the system may also reduce the reliability and increase the maintenance requirements of the system;

Level or grade crossing predictors and track circuits may have their reliability affected by weather, which may increase the maintenance activities required and may also cause otherwise unnecessary closure of the level crossing during adverse weather events such as significant rain;

Level or grade crossing predictors often require special operational rules to prevent trains from accelerating while on approach to a crossing, as the calculations used do not account for the acceleration of the train. To compensate for possible rule variability, additional warning time may be added to accommodate for acceleration, but as this is adjusting for warning time rather than the worst-case acceleration for the railway's trains, it is not guaranteed to work correctly under all scenarios, and it can be difficult to calculate if all scenarios have been accounted for. If trains operate outside of these parameters while on approach to the crossing, it is possible that a reduced warning time may be provided to the road traffic, which could increase the risk of a car or pedestrian and train collision.

Other methods of train detection, such as radar or induction loops, are also used. However, due to reliability and safety concerns, these methods are not as common. By way of example and incorporated within the current description by way of reference:

Geiger (U.S. Pat. No. 3,929,307) teaches a method of determining the speed of a train using a movement detector;

Farnham et al (U.S. Pat. No. 4,581,700) teaches a method of predicting train approaches using the impedance of the track coupled with a microprocessor computer;

Sharkey et al (U.S. Pat. No. 7,575,202) teaches a method of providing relatively constant warning times by measuring the speed of the train using a detector system;

O'Dell et al (U.S. Pat. No. 8,297,558) teaches a method of optimising warning signal times using maximum authorised speeds and track occupancy circuits;

Other methods have included determination of train position and velocity (Steffen et al U.S. Pat. No. 8,725,405 and Carlson et al US 2012/0138752). However, each of these methods and apparatus requires the use of specialised equipment that must be type approved for use on tracks under the control of a particular operator.

As such, these less common methods will not be discussed further in this document. The implications, disadvantages and any potential advantages of these less common technologies can be understood and applied to the methods discussed throughout this document by a person with knowledge in the art of applying such technologies and systems.

Therefore, the need exists for a robust system for detecting the presence and calculating the speed, of a train approaching a level crossing whereby the activation time for any warning system may be adjusted through a pre-defined period of time and by way of reference to the type of rolling stock that occupies the track and that may utilise equipment that is already typically in use on rail tracks.

SUMMARY OF THE INVENTION

The implementation of an axle counter based level crossing that can predict the speed of the train and adjust for the acceleration of the specific rolling stock will be used to increase reliability and ensure the minimum warning time is always provided to the road user.

The purpose of this invention is to detail methods, including equipment layout and configurations, and software code methods and algorithms for implementing reliable and safe speed detection of trains, and for reliable and safe calculation of their possible acceleration and associated calculations for determining when to activate level crossing protection systems to ensure minimum warning time at the crossing is met, while reducing the warning time provided for slower trains without the need for implementing additional operational procedures.

This invention includes methods for integrating technology components and systems to enable these level crossing approach calculations to be undertaken safely using equipment that is suitable for railway use.

Methods for calculating the maximum speed of a train at a given point of time based on the measurement and calculation of equipment delays, communication delays, train accelerations and equipment failure are proposed to increase reliability and provide methods for measuring the speed of a train.

Methods for calculating the current position of a train, given past, current and predicted future speed measurements are proposed to enable approximation of the arrival time of the train at the crossing and the approximate distance of the train from the crossing and determine an appropriate time to activate a warning system. This includes using information from the speed measurement and/or axle counter systems, and algorithms and computer software to determine the current and predicted distance from the crossing. These methods aim to produce a worst-case approximation of the time and distance, which in the case of a level crossing is the prediction model that results in the train being the closest (by time and/or distance) to the crossing. These methods are designed to safely reduce the error margin involved, as far as possible, and may also be applied in non-worst case forms or applications for various reasons, such as if they are backup calculation or if they are to be used for other purposes.

Methods involving the use of redundant approach calculations are proposed to increase the reliability of the system, including the accuracy and precision of speed measurement and safety of the system by producing worst case calculations and using redundant calculations and measurement information to ensure minimum warning time of the system.

Methods for using these redundant calculations and measurement devices to provide graceful modes of failure, where the level crossing can act in a degraded mode to improve the reliability of the crossing during equipment failure, such as the failure of an axle counter component, are also presented as part of this invention.

Methods for using existing technology that decrease development time and which may already be approved for railway use are included within the scope of this invention. Existing technology may allow the reuse of components and reduce additional maintenance and requirement for spares associated with the use of the technology. However, the methods proposed for this invention do not rely on the use of existing technology and may be implemented using new technology. It would be understood by a person familiar in the state of the art that these methods and their ability to be implemented on existing technology provide potential benefits.

Methods for monitoring potentially unsafe conditions or failures that may otherwise result in the system failing to provide an adequate warning time to the road user are also prevented as part of this invention.

In a preferred embodiment of the present invention there is disclosed a method for activating the warning system at a level crossing comprising:

detecting the presence of an approaching train wherein each axle of the train is detected by passing over a first axle counting wheel sensor positioned at a known distance from a second axle counting wheel sensor;

detecting the presence of an approaching train wherein each axle of the train is detected by a second axle counting wheel sensor positioned at a known distance from the first axle counting wheel sensor and the level crossing;

calculating the speed of the train by determining the time taken for each axle to travel between the two axle counting wheel sensors;

activating the level crossing warning system at a predetermined time based upon the calculated speed of the train.

In a second embodiment of the invention, a method for activating the warning system at a level crossing comprising:

detecting the presence of an approaching train wherein each axle of the train is detected by passing over a first axle counting wheel sensor positioned at a known distance from a second axle counting wheel sensor;

detecting the presence of an approaching train wherein each axle of the train is detected by a second axle counting wheel sensor positioned at a known distance from the first axle counting wheel sensor and the level crossing;

calculating the speed of the train by determining the time taken for each axle to travel between the two axle counting wheel sensors;

activating the level crossing warning system at a predetermined time based upon the calculated speed of the train;

detecting the presence of the departing from the level crossing wherein each axle of the train is detected by a third axle counting wheel sensor positioned at a location on the far side of the level crossing such that level crossing may be deactivated;

DETAILED DESCRIPTION OF THE INVENTION

Figure 1:
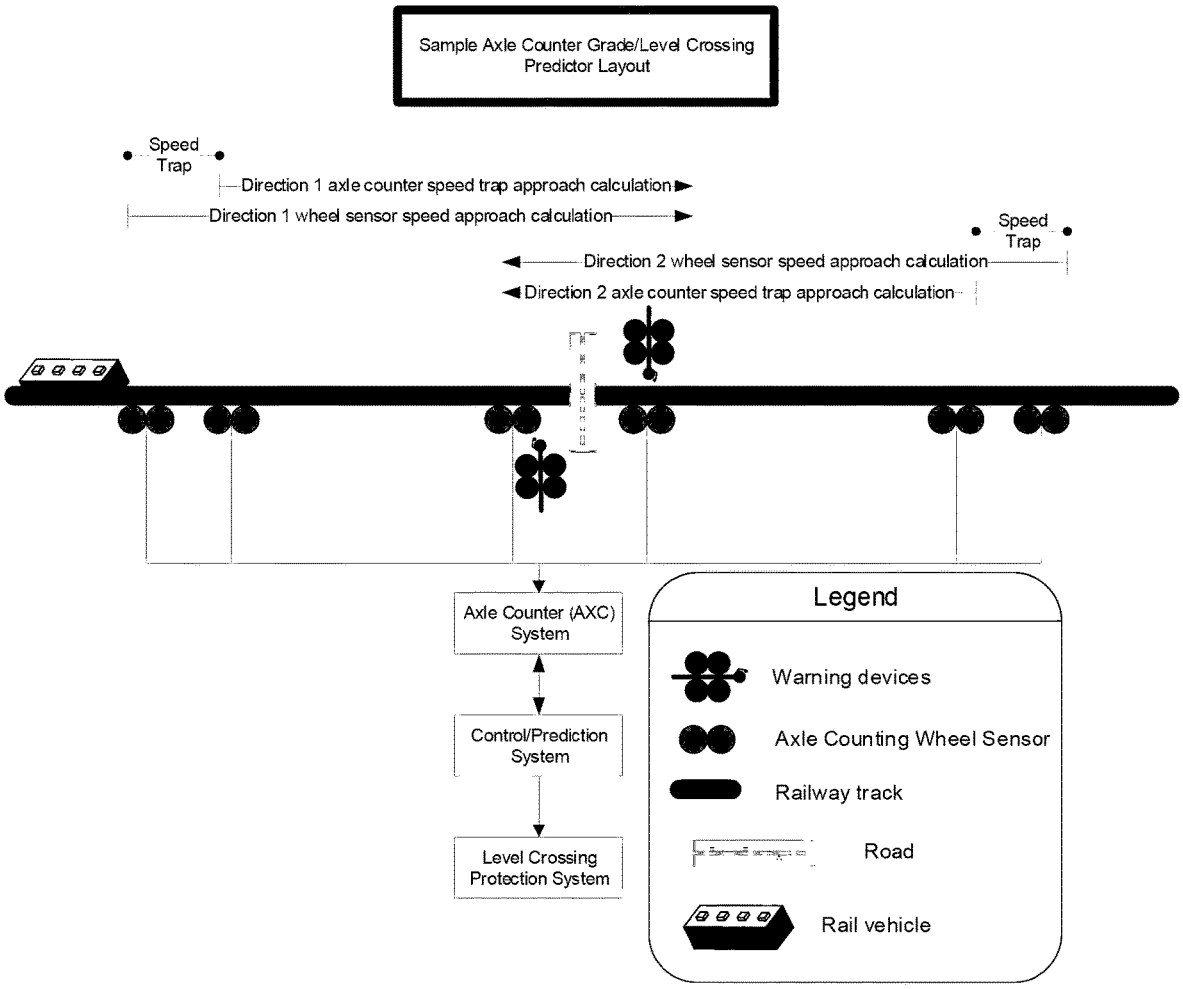
FIG. 1 shows a simplified diagram of a preferred embodiment of the current invention utilising axle counting wheel sensors.
Figure 2:
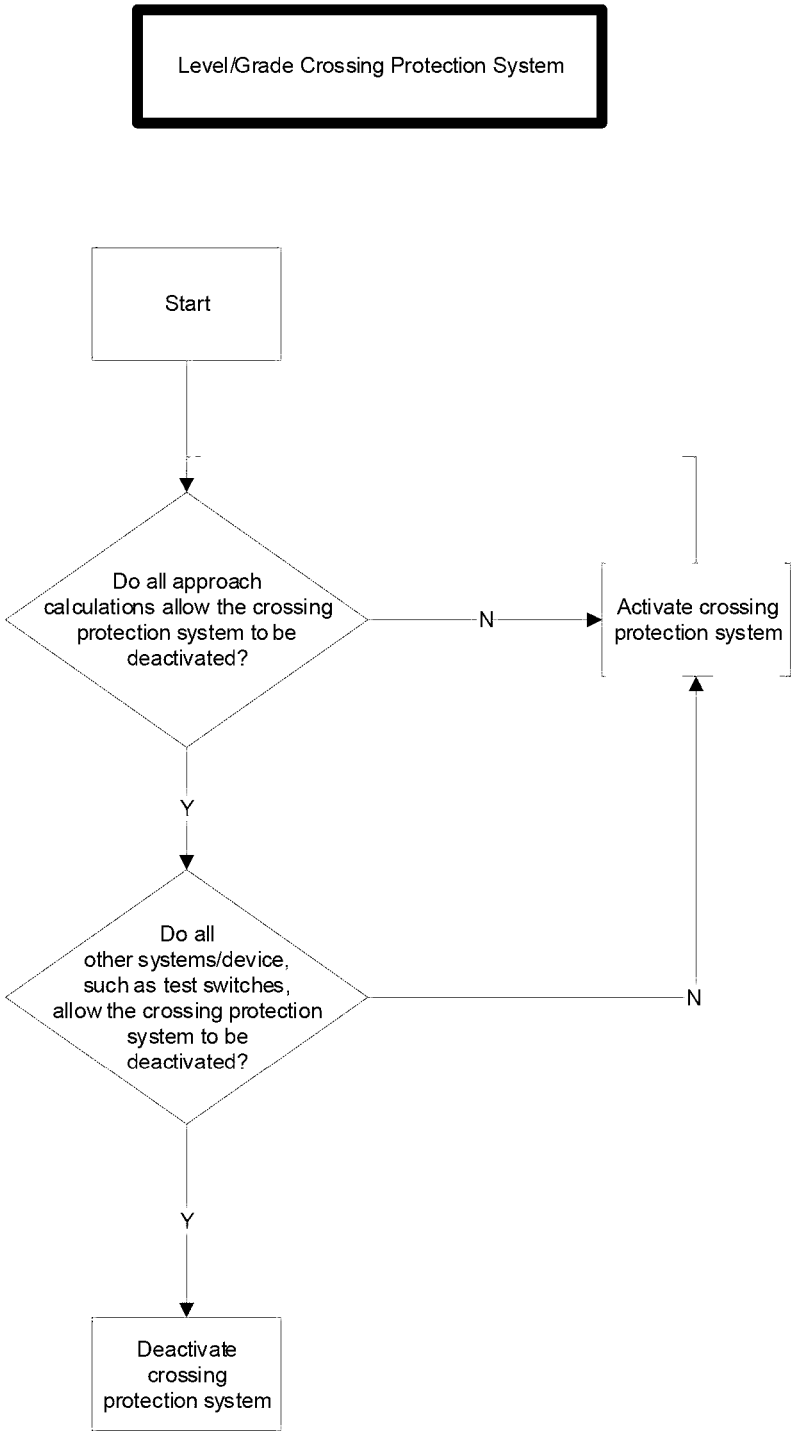
FIG. 2 shows a schematic illustration of a speed proving method.
Figure 3:
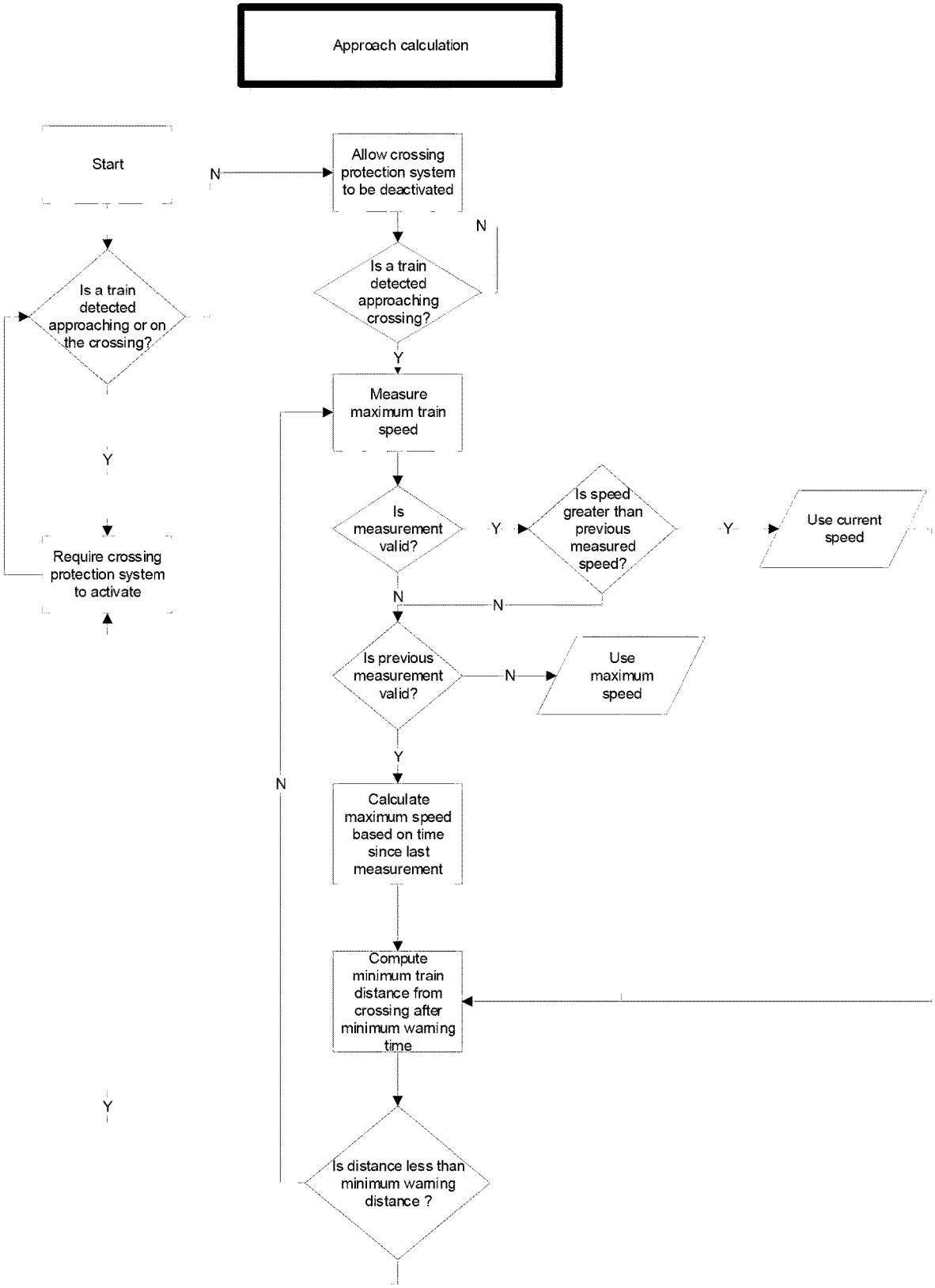
FIG. 3 shows a schematic illustration of an example approach calculation for the current invention.

It is possible for a train to accelerate at any time, invalidating the physics determined by the axle counter system that was founded on an assumption of constant velocity. The consequence of this freedom to accelerate and subsequent change in velocity is that the train can reach the level crossing in a reduced period of time compared to the initial calculation. Accordingly, in another preferred embodiment of this invention, the activation of the level crossing warning system may incorporate the additional feature of accommodating for the known acceleration characteristics of a train travelling on the track on which a level crossing is positioned. The acceleration characteristics of the train may be known in advance from the characteristics of the particular train type or may be determined from the characteristics of the fastest train type to travel on that train line such that the activation time for the warning system is a worst-case scenario.

Axle counters, along with additional information and algorithms, are used to detect the presence or absence of trains, the direction of their travel, the time that events occur, and the speed the train. However, it would be possible for someone familiar with the state of the art, to substitute other technology for some or all the methods contained here within.

In a further embodiment of the current invention, the level crossing warning system may be configured to contain multiple level crossing approaches that can detect a train travelling toward the crossing. Each one of these approaches may be configured with various parameters including:

The minimum speed the system may assume a train is travelling at for use in prediction algorithms;

The maximum speed allowed by the railway operational rules. This maximum speed may be used by the prediction algorithms for tasks such as limiting the predicted or measured speed. In some circumstances, it may be desirable to use a speed measurement that is larger than the maximum speed allowed by the railway operational rules, for example, to start the crossing warning devices earlier if an overspeed train is detected or suspected;

The maximum distance, based on measurement and/or prediction algorithms, that the train may be to the crossing before the crossing protection system is activated;

The distance from the crossing that the approach starts from, noting that this distance may be variable depending on the portion of the approach the train is detected on. For example, where an approach has multiple axle counter detection points, the relevant detection point that the train is detected on may have its own configurable distance from the crossing. Alternatively, another approach with a complete set of its own parameters may be used in this scenario. Allowing for the calculation of different approach distances the system can dynamically adapt based on the detection point of the train without the need for putting in additional train detection zone. The calculation of different approach distances may provide the benefit of reducing the amount of equipment required at the location. Such benefit is especially useful where there are switches (also known as points) or gauge splitters in the level crossing approach that allow the train to approach from different railway tracks and/or directions.

Figure 4:
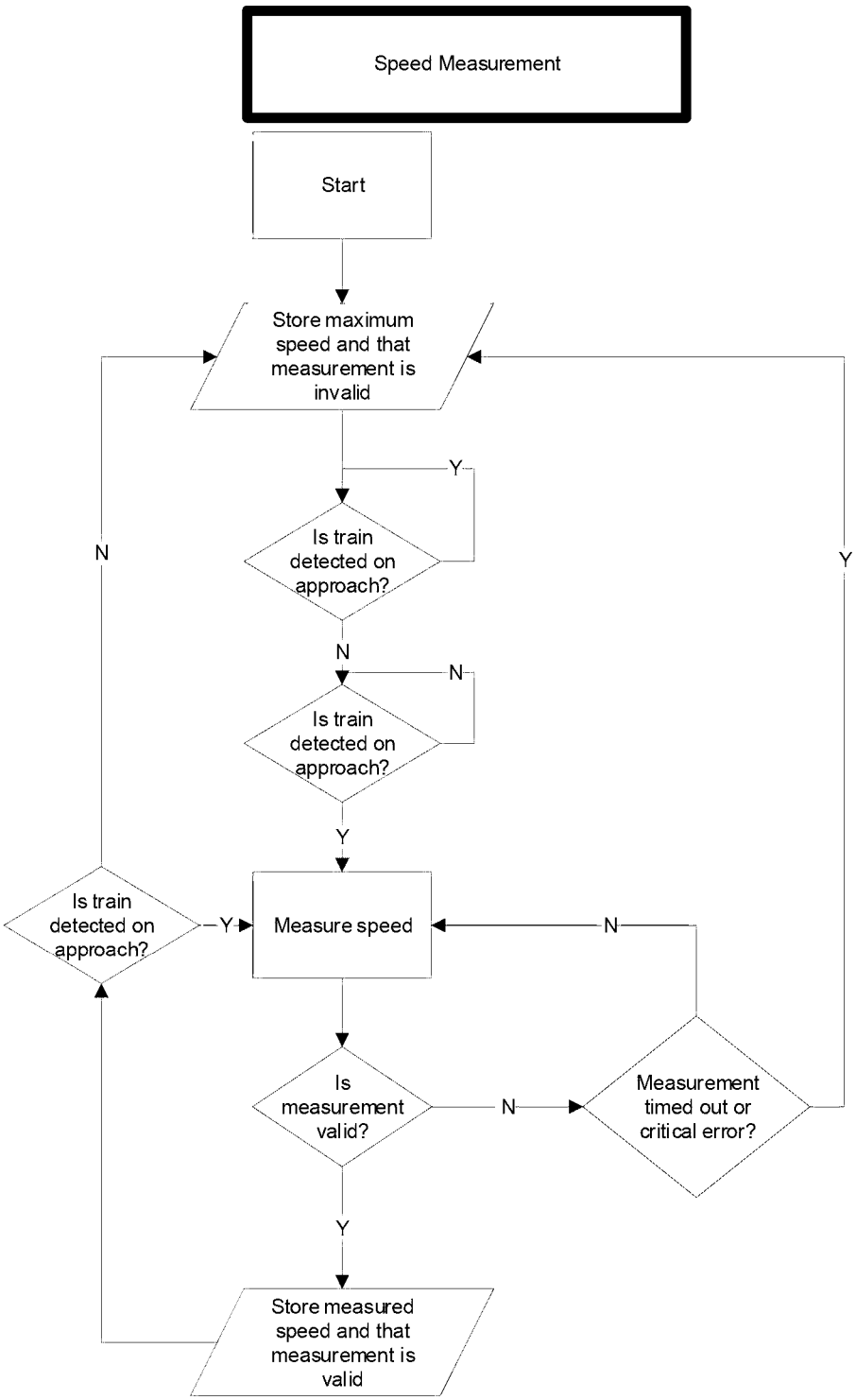
FIG. 4 shows a schematic illustration of an example speed calculation for the current invention.

An example of a typical approach calculation is exemplified in FIG. 4.

For some approach calculations, it may be appropriate to ensure this is the absolute minimum warning time, for example by assuming the worst case (i.e. ensuring all calculations are worst-case, for example assuming the train is travelling and accelerating as fast as possible and that any system reaction times are assumed to be worst case). Other approaches may use a less conservative approach, for example, if additional time is built into the minimum warning time or if there is another approach calculation that assumes worst case (such that the worst-case calculation approach provides a fall back from the other approach calculation(s)).

Acceleration data may be adjusted based on the speed and/or length, or other detected parameters of the train. Similarly, it may also be adjusted based on the detection point of the train and on the gradient of track on detected approach. This allows the system to predict the current or future maximum speed of the train even after it has passed a speed measurement device or area.

If redundant approaches are used for a particularly directional approach to the level crossing, it is possible to configure the system to have graceful modes of failure. In many configurations, it can be possible to disable certain elements of the system, such as speed measurement and prediction elements. The crossing can operate in a degraded mode allowing it to recover and safely operate on a reduced component set. Such recovery will allow for train presence determination and open the road when no trains are around, rather than forcing crossing closed until the fault is manually rectified.

Graceful modes of failure are not just limited to redundant approaches, but may also be implemented within each approach's algorithm to provide further graceful modes of failure. For instance, in the case that the speed measurement is not deemed reliable or accurate due to monitored health elements of the system or other conditions, it may be possible to assume the worst case operational speed or to activate the crossing whenever a train is detected.

One limitation of axle counter crossings is often that the hi-rail vehicles can cause disturbances to the level crossing system. To help avoid these disturbances the following controls may be implemented in the algorithms discussed, both with or without speed proving:

- A push button, or similar type device such as a switch or remote activation device, may be provided to the hi-rail operator to use before entering the start of the approach to inhibit the detection of the axle counting system. This inhibition may be setup to inhibit the system only for a certain number of wheels, such up to two or three wheels such as that with locomotives;
- The wheel diameter of the vehicles may be detected and used to inhibit the system or reset the axle counting system;
- Supervisor sections may be configured such that when a hi-rail getting on at the crossing:

The track section between the two edges of the crossing (island track axle counting system), is automatically reset by other track sections between wheel sensors that are not on the edge of the crossing. For instance, when the hi-rail travels over the corresponding wheel sensors and causes a negative count the track section is reset; the hi-rail entered the axle counter system in the middle rather than at the edge of the axle counting section, and a negative count occurs, triggering the reset. This track section is commonly known as a supervisor section.

The next axle counting sections after the island track may then be configured not to automatically reset as the axle counting will contain the correct number of sections. However, the supervisor sections that are above these sections may be automatically reset by these sections, such that if the train leaves the approach sections boundaries then when the supervisors enter a negative count status they are automatically reset by the approach tracks, thus allowing automatic restoration of the axle counting sections without any user intervention.

Logic may also be implemented in the axle counting or control system logic to reset the axle counter when a hi-rail exits the crossing after entering from a boundary. For example, the axle counter system may be manually or automatically reset when the following conditions occur.

In another embodiment of the invention there may also be included a timer and may also count the number of axles in the section. For example, it may check that the number of axles in the section is two, which is the expected axle count of a hi-rail vehicle. Other parameters, such as the speed, number of axles, wheel diameter, weight or similar parameters may also be used in this calculation.

A switch may be provided to the hi-rail operator to indicate to the system they have left the crossing. The system may then choose to perform any necessary safety checks, such as also checking the status of the approach track sections, island track(s), speed, the number of axles, wheel diameter, weight, etc.

The system may also be configured to monitor and calculate the maximum acceleration, maximum speed, and other parameters of the crossing. The system may then choose to retain these values such that they can be used for future calculations as the maximum values if they are larger than the maximum values that have been configured in the system. These parameters may be stored in non-volatile memory such that they are remembered in the event of a power loss or may be stored in such other memory system as may be applicable to the art. The calculation of current operating parameters based on gathered and retained data is useful. This retained data could be used to flag alarms:

- should the system be incorrectly configured;
- updated settings conflict with retained observed data;
- new observations differ significantly from the past (new rail vehicles with increased velocity and acceleration are introduced after crossing commissioning).

In this way, an additional level of safety can be provided to the crossing control system. These figures may be used on all or some of the approach calculations. Alarms and event logs may also be generated when adjustments such of these are made.

The use of multiple approach calculations and parameters to increase reliability and safety may also be used pursuant to the current invention. Whilst the current invention does not necessarily require the use of multiple calculations to operate, they may be utilized where required or desirable such as where a second set of axle counters are utilized so as to confirm the readings of the first.

In another embodiment of the current invention, the reliability of the level crossing warning system can be improved, by separately determining if the various redundant approaches are clear of trains. Such an approach allows for the failure of one or more axle counters, or other train detection devices, to occur without the level crossing protection system being activated without a train present.

An approach calculation may be used to determine any or all the following in order to timely and/or safely activate the crossing:

- Determine the acceleration of the rail vehicle based on the configuration variables and/or measured parameters of the train. The configuration variables may include configuration based on the type of rail vehicle, the gradient of the approach, the maximum acceleration of the rail vehicle given its current speed and/or other parameters. The measured parameters may include the rail vehicle's speed, direction of travel, wheel diameter, number of wheels/axles, distance between wheels/axles, length, weight or otherwise similar parameters;
- The prediction of current speed after obtaining speed measurement, which may be calculated based on the current measured speed, calculated maximum or current acceleration, and calculations that predict the future speed, or maximum speed, of the rail vehicle;

Prediction of current and future position of the train based on the current and/or future predicted velocities of the train. The current and future positions of the train in conjunction with their times and the configured minimum warning times of the approach, along with any other configured variable including the minimum warning distance of the crossing, may be used to activate the crossing such that the minimum warning time or minimum distance may be obtained. The minimum warning time may also refer to the desired warning time for approaches that are not configured to match the absolute minimum warning time of the rail operator. For example, some rail operators may have a minimum warning time that must be achieved, which may be programmed into one approach calculation to ensure this time is met, but then also have a desirable warning time that is greater than this minimum warning time that is desirable to meet. This need could be due to wanting to ideally provide the road users with the desirable time (e.g. 30 seconds), but allowing for cases where this approach calculation may not always guarantee this desirable warning time and therefore the other lower minimum warning time may be programmed into another approach as an additional safety guard;

In some preferred embodiments of the current invention, the approach calculation may also make corrections based on the filtering of speed measurements. For example, it may choose to use the maximum, average, median or another type of filter to filter the speed measurements. It may also require several speed measurements before allowing a speed measurement to be determined valid and it may also require these speed measurements to be within a certain range to be determined fail. It may also monitor the health of the speed measurement devices or other devices that may indicate a failure in the speed measurements. In the case of a failure, it may choose to select a different speed, such as the configured maximum speed, or the maximum measured speed previous, or the maximum calculated speed based on a previous speed measurement, or any other speed measurement that the approach calculation algorithm may deem as appropriate. In the case of a failure, it may also deem it appropriate to start the level crossing warning system.

In another preferred embodiment, the system may also make corrections based on the cycle time measurement or maximum configured cycle time of any of the devices, including the speed measurement system, axle counting system, or the control system, and/or any other devices. In this way, the cycle time may be used to adjust the current or future predicted speed, acceleration, distance or time from the crossing and to activate the crossing warning systems earlier to later as required.

In a further embodiment of the invention, the system may also make corrections based on the system latency time measurement or maximum configured latency time of any of the devices, including the speed measurement system, axle counting system, or the control system, and/or any other devices. In this way, the latency time may be used to adjust the current or future predicted speed, acceleration, distance or time from the crossing and to activate the crossing warning systems earlier or later as required.

In another embodiment of the current invention, the system may implement methods to determine a second train approaching. The approach calculation may then either use this information to ensure the crossing activates correctly for the second train and also to ensure the information of the second train, does not cause any incorrect operation of the crossing for the first train. The system may choose to do this by adjusting for the second train, or by implementing fail-safes such as to ensure that the maximum speed of either train is used and that the crossing does not recover after the first train has left the crossing.

The invention may also use information from other approach calculations to ensure that the level crossing remains down for a second train, such that warning devices do not stop briefly between trains. In this embodiment, if a train is on another approach the warning time or approach distance of some or all other approaches may be adjusted. Such adjustment will ensure that the crossing either remains closed for the second train or that it has enough time to recover and let crossing users through (oftentimes referred to as the crossing minimum opening time). This function is particularly novel where boom barriers (sometimes known as boom gates) or other mechanical protection devices are installed at level crossings, and it is not desirable to start to raise or open the boom barriers if another train is going to activate the crossing soon as this may confuse the crossing users.

It will be apparent to any person skilled in the art that in carrying out the present invention:

Multiple measurement devices may be installed to update the speed of the train along the approach. These multiple devices will aid in decreasing the error margin. The safety and/or reliability of the approach speed measurement will improve;

Speed measurements indicate that a train is travelling above the maximum speed allowable by the railway may be either:

discarded;

used to start the crossing warning system early used to trigger an alarm for an over speed train;

indicate the system that the speed measurement device is unhealthy and may not be used.

This speed information may also be used to activate other crossings or signalling functions, such as a close by crossing, to ensure minimum warning time is met for the next train. Signalling functions, such as automatic train protection, to stop or reduce the speed of the train, may also be issued through the system, other subsystems or other connected systems;

Speed measurements may be obtained from other subsystems or connected systems, such as the axle counter system, or computer based on information obtained or calculated from the system or other subsystems or connected systems. For example, a speed trap may be used to determine the time between two events and based on the two different events, such as determine how fast the train has travelled over a certain distance in a certain time and adjust for the configured parameters, such as timing, acceleration, latency, cycle times, etc. An example of one method of speed calculation for the current invention may be seen in FIG. 4.

In various embodiments of the current invention, the system may make adjustments for the accuracy and/or precision of the speed measurement using filtering, applying a safety or adjustment margin, or through any means available to correct or adjust the speed measurement available to a person skilled in the art.

A speed trap may be implemented by measuring the time it takes for a train to travel over a portion of track;

This portion of track may be a large (long) portion (typically 10 seconds at maximum line speed) of track or a short portion of track (typically 2 to 30 m);

The measurement of the speed may be adjusted or filtered to improve the accuracy, reliability or safety of the measurement.

Prediction of speed may be adjusted or selected based on:

Average speed;

Maximum acceleration over the portion of track

The system may implement methods for guarding against a failed speed trap section such as The use of additional speed measurement devices, such as the use of the speed value determined from the axle counter sensors or other speed measurement devices;

Monitoring the time between measurements;

Using track occupancy devices, including axle counters, to determine if a train has been;

Monitoring the health and/or status of various devices, including the axle counter sensors and track occupancy devices. For example, the direction information on wheel sensors may be monitored to ensure that the system has been healthy and has not or has detected the presence of a train within a certain time period. Such mechanisms, for example, could be used to determine if a speed trap has failed to avoid the scenario where a train may appear slower than it is (in the case that the time between two sensors or devices is increased by a failure of a device or sensor or algorithm, etc.).

In a further embodiment of the current invention, the type of train (e.g. shorter and faster suburban train or longer and slower freight trains) may be determined by detecting each axle using the one or more axle counters comprised in various embodiments of the current invention and wherein the maximum acceleration and/or deceleration, maximum speed and length may be incorporated into the calculation of any maximum possible acceleration of the particular type of train that has been detected. Such an approach will ensure that the warning system is not activated for longer than necessary for trains with lower speed and acceleration and ensures adequate warning for trains with increased speeds and acceleration.

The various embodiments are given by way of example and the scope of the invention is not intended to be limited by the examples provided herein and may be taken to include the use or incorporation of other devices or systems as would be obvious to those of the ordinary skill in the art.

The invention claimed is:

1. A method of delaying activation of a warning system of a level crossing configured to assume a maximum speed of an approaching train and calculate an estimated arrival time for activating the level crossing therefrom, the method comprising:

(a) detecting the presence of an approaching train having a plurality of axles, wherein a first axle speed for a primary axle of the train is detected by passing over a first axle counting wheel sensor positioned at a first distance from the level crossing;

(b) detecting the presence of the approaching train wherein a second speed for the primary axle of the train is detected by a second axle counting wheel sensor positioned at a second distance from the level crossing;

(c) measuring the time taken for the primary axle to travel between the first axle counting wheel sensor and the second axle counting wheel sensor to calculate an average primary axle speed for the primary axle of the train;

(d) comparing the detected second axle speed to the average primary axle speed to assess whether the detected second axle speed is determined valid or determined fail and, where if the detected second axle speed of the primary axle is determined valid;

(e) calculating an arrival time for the train at the level crossing based on the second detected axle speed of the primary axle; and (f) determining a maximum safe delay for activating the warning system of the level crossing based on the difference between the calculated arrival time of the train and the estimated arrival time.

2. The method of claim 1, wherein steps (a)-(d) are repeated for each subsequent axle of the train in a dynamic calculation until the warning system of the level crossing is activated.

3. The method of claim 2, further comprising the steps of:

comparing the second detected speed of the primary axle to the second detected speed of the subsequent axle of the train, and where the second detected speed of the subsequent axle is greater than the second detected speed of the primary axle;

recalculating the arrival time for the train using the second detected speed of the subsequent axle to reduce the maximum safe delay for activating the warning system of the level crossing.

4. The method of claim 2, further comprising the steps of:

comparing the second detected speed of the primary axle to the second detected speed of the subsequent axle of the train, and where the second detected speed of the subsequent axle is less than the second detected speed of the primary axle.

5. The method of claim 1, further comprising the step of activating the warning system of the level crossing in response to a plurality of second axle speeds determined fail.

6. The method of claim 1, further comprising the step of determining a zero value for the maximum safe delay for activating the level crossing in response to a plurality of second axle speeds determined fail.

7. The method of claim 1, further comprising the step of:

calculating an average axle speed for the train based on axle speed readings from the plurality of axles of the train, and comparing the average axle speed against the detected second axle speed; and recalculating the maximum safe delay based on the greater of the average axle speed and the detected second axle speed of the train.

8. The method of claim 1, further comprising the additional step of locating a supplementary axle counting wheel sensor between the level crossing and the second axle counting wheel sensor;

detecting a third axle speed of the primary axle of the train passing over the supplementary axle counting wheel sensor;

measuring the time taken for the primary axle to travel between the second axle counting wheel sensor and the supplementary axle counting wheel sensor to calculate a second average primary axle speed for the primary axle of the train;

comparing the third detected axle speed to the second average primary axle speed to assess whether the third detected axle speed is determined valid or determined fail, and where the third detected axle speed of the primary axle is determined valid;

calculating a second arrival time for the train at the level crossing based on the third detected axle speed; and recalculating the maximum safe delay to activate the warning system of the level crossing based on the difference between the second calculated arrival time of the train and the estimated arrival time.

9. The method of claim 1, further comprising the step of:

detecting the presence of the train when moving away from the level crossing wherein each axle of the train is detected by a third axle counting wheel sensor positioned at a third distance from the level crossing, the third axle counting wheel sensor located on an opposing side of the level crossing to the first and second axle counting wheel sensors;

comparing the number of axles detected by the first axle counting wheel sensor to the number of axles detected by the third axle counting wheel sensor, and when the number of axles detected by the third axle counting wheel sensor equals the number of axles detected by the first axle counting wheel sensor;

deactivating the warning system of the level crossing.

10. The method of claim 1, comprising the additional step of:

determining the type of train approaching the level crossing and comparing a known maximum length of said train type against the second detected axle speed of the primary axle; and adjusting the maximum safe delay for activating the warning system of the level crossing based upon each of the second detected axle speed of the primary axle and the known maximum length of the train type.

11. The method according to claim 1, wherein the step of calculating the average primary axle speed for the primary axle of the train comprises filtering each detected axle speed of the plurality of axles to adjust for accuracy in determining the maximum safe delay for activating the warning system of the level crossing.

12. The method according to claim 11, wherein the filtering uses any one or more of: a maximum, an average, and a median filter.

13. The method according to claim 11, wherein the step of filtering each detected axle speed for each of the plurality of axles of the train comprises calculating at least one of: a maximum axle speed, an average axle speed, a median axle speed, and a minimum axle speed, among speed results for each axle of the train.

14. The method according to claim 1, wherein the step of calculating the average axle speed comprises measuring and validating axle speeds for each axle of the train in a repeated calculation.

15. The method according to claim 14, wherein the step of validating axle speeds for each axle of the train comprises confirming whether one or more of the axle speeds fall within a predetermined range of one another.

* * * * *